United States Patent [19]

Allen et al.

[11] 4,361,245

[45] Nov. 30, 1982

[54] DUSTLESS ASH REMOVER

[76] Inventors: Hugh T. Allen, P.O. Box 763; D. Wayne Henson, Rte. #4, both of Canton, N.C. 28716

[21] Appl. No.: 122,581

[22] Filed: Feb. 19, 1980

[51] Int. Cl.[3] ..... B65D 43/26

[52] U.S. Cl. ..... 220/2; 220/264; 15/257.6

[58] Field of Search ..... 220/2, 260, 262, 263, 220/264; 15/257.6

[56] References Cited

U.S. PATENT DOCUMENTS

| | | | |
|---|---|---|---|
| 32,368 | 5/1861 | Horstmann | 15/257.6 |
| 507,826 | 10/1893 | Miller | 15/257.6 |
| 760,467 | 5/1904 | Michaud | 15/257.6 |
| 879,144 | 2/1908 | Chamberlin | 220/263 |
| 1,470,205 | 9/1923 | Vogt | 220/2 |
| 1,847,476 | 3/1932 | Fuhr | 220/2 |
| 2,759,625 | 8/1956 | Ritten | 220/262 |
| 4,212,408 | 7/1980 | Valenzona | 220/264 |

FOREIGN PATENT DOCUMENTS

| | | | |
|---|---|---|---|
| 485666 | 5/1927 | Fed. Rep. of Germany | 220/2 |

*Primary Examiner*—George E. Lowrance

*Attorney, Agent, or Firm*—Lane, Aitken, Kice & Kananen

[57] ABSTRACT

A sheet-metal constructed container to facilitate the removal and disposal of ashes from solid fuel burning stoves and heaters, thereby eliminating dust and spilled ashes.

1 Claim, 1 Drawing Figure

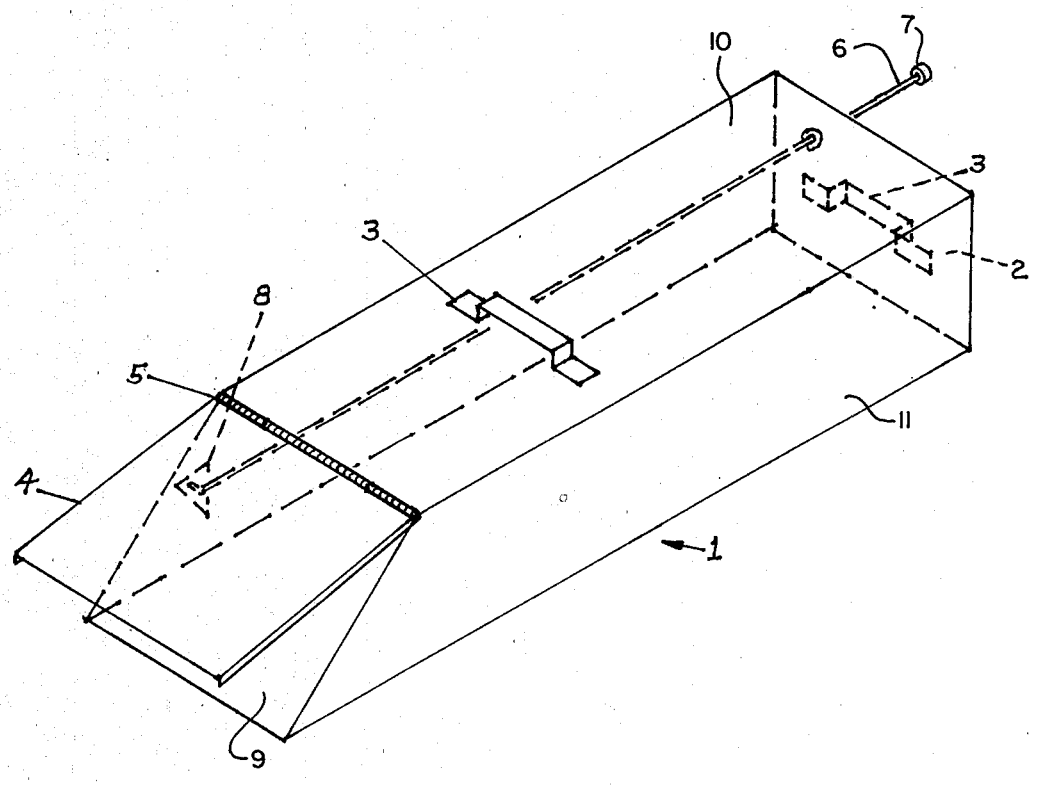
10
6
7
3
3
2
8
5
11
4
1
9

DUSTLESS ASH REMOVER

BACKGROUND OF THE INVENTION

1. Field of the Invention

This invention pertains generally to the structure and use of a closed container for the dustless removal of ashes from solids burning stoves and heaters, either free-standing or recessed into fireplaces.

2. Description of the Prior Method

The most generally used methods of ash removal from wood and coal burning stoves are (1) use of a small shovel and dumping ashes into receptacle and (2) use of a "hoe-like" device on a long handle to pull ashes from a fire-box, letting them fall into a receptacle. Either method results in ash particles dropping on the carpet or floor and causing dust to be stirred up which settles on the carpet, furniture, drapes, floor, etc. Some ashes are still hot and not all receptacles used are fire-resistant, a combination which has the potential of being a fire hazard. The dust itself can be a health hazard to those people who may suffer from asthma, emphysema, or other respiratory ailments.

SUMMARY OF THE INVENTION

The use of an ash removal unit of the type presented herewith allows ashes to be collected in a container which can be closed while still inside the solid fuel burning system, then withdrawn, preventing spillage of ashes and/or the escape of dust particles. This permits removal of ashes while still hot, eliminates the need of local dusting and cleaning and safeguards the health of those persons who may suffer with respiratory ailments. Upon discharge of ashes from unit, the unit can also be used to transport wood or coal back to replenish same in stove or heater. The receptacle eliminates the dropping of ashes on the floor or carpet and the resultant dirt, stains, burn spots and the potential hazard of fire. The receptacle can handle hot ashes or live coals for a period of time without creating a fire hazard. The receptacle is provided with a sloping entry that inserts the bottom farther into the stove than the top, thereby allowing a clean pick-up of ashes with less spillage. The receptacle is also provided with a lid which can be manipulated from the outside, thereby sealing off dust.

DESCRIPTION OF THE DRAWING

One drawing only is required which is an external perspective view showing general construction of the "Dustless Ash Remover".

DESCRIPTION OF THE PREFERRED EMBODIMENT

As can be seen from the drawing, a container or receptacle 1 has a main body which is 32 inches long, 9½ inches wide and 6 inches deep, and is completely sealed by any accepted practice of duct or sheet-metal fabrication. The container 1 includes a front or open end which is sloped from a bottom wall 9 to a top wall 10 at an angle of approximately 45°, resulting in the top wall 10 having a length of 26 inches. A pair of side walls 11 extend between the bottom wall 9 and the top wall 10 and include edges at the front end of the container 1 which are sloped at the approximately 45° angle. The bottom wall 9 extends forward farther than the top wall 10, thus defining a lip. A cover or lid 4 is fastened to the front edge of the top wall 10 by one continuous hinge 5.

As can be seen from the drawing FIGURE, the lid 4 has a length substantially equal to the length of the sloped edges of the side walls 11 and is biased by gravity to pivot downward into engagement with the bottom 9 of the container 1. The lid 4 has turned down edges along two sides to effect sealing of the container. A metal tab 8 is riveted or welded to the lid 4 and is provided with a hole for receiving a push-pull operating rod 6, the hole being only slightly larger than the diameter of the rod 6. A locking device must be provided on the end of the rod 6 on the backside ofthe metal tab 8 to prevent disengagement of the tab 8 and the rod 6. Opposite the open end of the container 1 is an end which is closed by a rear wall 2. The rear wall 2 is provided with a hole, also only slighly larger than the rod 6, to permit the lid 4 to be operated from the closed end of the container 1. A knob 7 can be mounted on the rod 6 for easier control of the push-pull action. A pair of handles 3 is secured to the container 1, one handle 3 mounted on the top wall 9 and the other handle 3 mounted on the rear wall 2 adjacent to the hole and the rod 6. The walls 9–11, the tab 8 and the lid 4 are constructed of 28 gauge sheet metal or aluminum. The rod 6 and the knob 7 can be made of brass, with the rod 6 having a diameter of about 3/16th inch and with the knob 7 having a somewhat larger diameter.

It is understood that this invention is not confined to the particular embodiment described herein, which is illustrative, but embraces any and all modified forms which come within the scope of the following claims.

We claim:

1. A receptacle adapted for removing ashes comprising:

a top wall;

a first handle secured to the top wall;

a flat bottom wall adapted to rest flat on a surface;

a pair of opposite side walls extending between the top wall and the flat bottom wall;

a rear wall;

a second handle mounted on said rear wall;

an open front end opposite the rear wall;

a lid pivotally connected to the top wall adjacent the open front end to close the open front end;

the flat bottom wall extending beyond the top wall at the front end to define a lip coplanar with the rest of the flat bottom wall;

the side walls including sloped edges extending between the top wall and the flat bottom wall, and the lid having a length substantially equal to the length of said sloped edges, whereby the lid is biased by gravity against the flat bottom wall when the flat bottom wall rests flat on said surface;

a hole defined in the rear wall adjacent to said second handle; and an operating rod connected to the lid and extending through the hole in the rear wall for reciprocation therein, whereby the lid may be selectively opened and closed from a location remote from the front end.

* * * * *